US005116341A

United States Patent [19]

Cameron

[11] Patent Number: 5,116,341

[45] Date of Patent: May 26, 1992

[54] LIFTING SHACKLE

[75] Inventor: David S. Cameron, Ecton Brook, England

[73] Assignee: British Guide Rails Limited, West Bromwich, England

[21] Appl. No.: 640,315

[22] PCT Filed: Jun. 1, 1990

[86] PCT No.: PCT/GB90/00847

§ 371 Date: Feb. 1, 1991

§ 102(e) Date: Feb. 1, 1991

[87] PCT Pub. No.: WO90/14965

PCT Pub. Date: Dec. 13, 1990

[30] Foreign Application Priority Data

Jun. 2, 1989 [GB] United Kingdom ..... 8912661

[51] Int. Cl.[5] ..... B66C 1/64

[52] U.S. Cl. ..... 294/67.3; 294/82.35; 294/85

[58] Field of Search ..... 294/1.1, 67.1, 67.3, 294/67.31, 81.1, 81.2, 81.5, 81.51, 81.56, 81.6, 81.61, 82.1-82.13, 82.17, 82.24, 82, 32-82.35, 85, 90, 101, 103.1, 106, 113, 169, 170; 248/228

[56] References Cited

U.S. PATENT DOCUMENTS

| | | | |
|---|---|---|---|
| 1,406,811 | 2/1922 | Bachrik | 294/170 X |
| 1,751,309 | 3/1930 | De Mone | 294/82.35 X |
| 1,768,484 | 6/1930 | Lotts | 294/82.35 X |
| 1,774,623 | 9/1930 | Williams | 294/67.3 X |
| 2,384,307 | 9/1945 | Husson et al. | 294/67.31 |
| 2,542,289 | 2/1951 | Robbins | 294/82.1 |
| 3,010,751 | 11/1961 | Day et al. | 294/81.56 X |
| 3,879,078 | 4/1975 | Turner | 294/67.31 |
| 3,895,836 | 7/1975 | Barnes | 294/82.35 |
| 3,958,825 | 5/1976 | Diamond | 294/82.13 |
| 4,221,419 | 9/1980 | Riley et al. | 294/85 X |
| 4,281,868 | 8/1981 | Lovitt | 294/106 |
| 4,371,203 | 2/1983 | Munro | 294/85 X |
| 4,452,481 | 6/1984 | Williams | 294/90 X |

FOREIGN PATENT DOCUMENTS

| | | | |
|---|---|---|---|
| 1290318 | 9/1964 | Fed. Rep. of Germany . | |
| 1320579 | 1/1963 | France . | |
| 219164 | 2/1985 | German Democratic Rep. | 294/85 |
| 683982 | 9/1979 | U.S.S.R. | 294/82.35 |
| 1397075 | 6/1975 | United Kingdom | 294/85 |
| 2166412 | 5/1986 | United Kingdom | 294/82.35 |

*Primary Examiner*—Johnny D. Cherry
*Attorney, Agent, or Firm*—Oblon, Spivak, McClelland, Maier & Neustadt

[57] ABSTRACT

A lifting shacklé comprises a head plate (1) having a central aperture (4). A pair of load supporting arms (2) are each attached pivotably to the head plate at respective points substantially equi-distant from a vertical, in use, axis of the head plate passing through the aperture (4). The load supporting arms define facing channels which receive laterally spaced edges of the load. At or near the remote end of each load supporting arm (2) a load attachment bar (5) is provided for engaging the load to be lifted.

5 Claims, 1 Drawing Sheet

LIFTING SHACKLE

The present invention relates to a lifting shackle. More particularly, but not exclusively, it relates to a lifting shackle for raising longitudinally extending loads by means of one end thereof. One example is a lifting shackle for raising lift guide rails, and such a shackle will be described in the present application. However, it will be appreciated that shackles embodying the present invention may also be used to raise metal girders and the like.

Lift guide rail sections are generally 5 meters long and may weight up to 500 lbm. They take the form of an elongate guide rail provided at its foot with a pair of laterally extending flanges. One guide rail section may be attached to an adjacent one by means of fish plates bolted through fish plate holes provided in the flanges at or near each end of the guide rail section.

Hitherto, such guide rail sections have been raised by use of winch hooks and/or slings connected directly to the fish plate holes in the lateral flanges of the guide rail section. However, this is not an ideal method for installing guide rails because of the difficulty of controlling the movement and orientation of a guide rail section as it is raised and as it is lowered into position. Furthermore, the sections are generally stacked in a horizontal disposition but must be installed in a lift shaft in a vertical disposition. Existing methods of lifting cannot always deal with the conversion from horizontal to vertical.

Particularly in the case of high speed, high rise lifts, but also to a lesser extent with other lifts, it is important that the final guide rail assembly is vertical throughout its length and that there are no marked discontinuities where the sections join one another. With conventional methods of lifting guide rails, it is often not easy for those installers working in a lift shaft to ensure that the guide rail fulfills the above conditions.

It is an object of the present invention to provide a lifting shackle which will overcome or reduce the above disadvantages and thereby ease installation of a lift guide rail or the like.

According to the present invention there is provided a lifting shackle comprising a head plate means having or being connected to an aperture, a pair of load supporting arm means each attached pivotably to said head plate means at respective points substantially equi-distant from a vertical, in use, axis of the head plate means passing through the aperture, and means at or near the remote end of each of said load supporting arms for engaging a load to be lifted.

Preferably each one of said pair of load supporting arm means comprises a pair of elongate arms rigidly connected together to define in horizontal cross section a U-shaped channel between the arms, said channel being dimensioned to accommodate a lateral edge of a load to be lifted.

The means to engage the load to be lifted may each comprise a removable load attachment bar passing through opposed apertures in the arms of the U section and through an aperture adjacent a lateral edge of the load which is accommodated in the channel between the U section arms.

The removable load attachment bars may each be locked in place by a pair of clip means affixable to exposed opposite ends of the attachment bar.

The clip means may be retained by chains attached to the respective load supporting arm means.

A pair of load adjustment screw means may be provided, one in each load supporting arm means and passing through one of the arms of the U section, to bear against a load adjacent its lateral edge and urge it towards abutment with the other arm of said U section, whereby the position of the load within the channels of the load supporting arm means may be adjusted.

An embodiment of the present invention will now be more particularly described by way of example and with reference to the accompanying drawings, in which.

Figure 1:
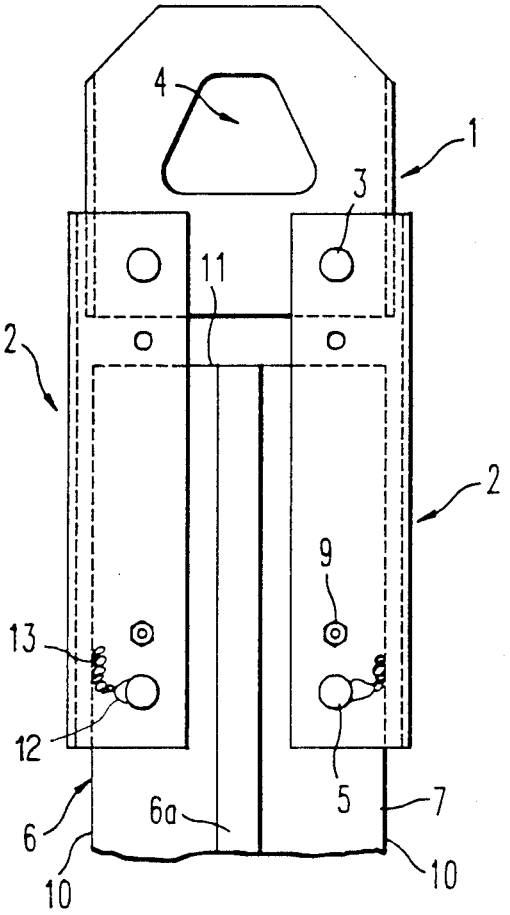
FIG. 1 is a front elevation of a preferred embodiment of lifting shackle, shown supporting a lift guide rail.
Figure 2:
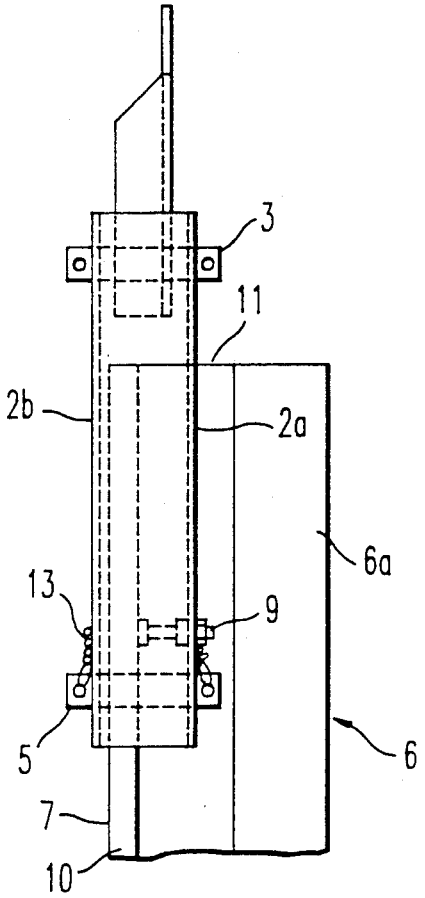
FIG. 2 is a side elevation of a lifting shackle of FIG. 1.
Figure 3:
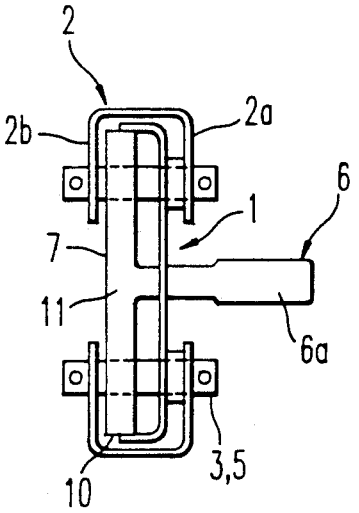
FIG. 3 is a plan view of the lifting shackle.

As stated above, whilst lifting shackles embodying the present invention may be used to lift any elongate load, they will be described with reference to their use in raising a lift guide rail 6. Such a guide rail comprises a central ridge 6 which, in use, performs the guiding function, and which has a pair of lateral flanges 7 extending from a base thereof, each flange having a side edge 10 extending in the same general direction away from the top part 11 of the rail section 6. At each end of each guide rail section, at least a pair of fish plate holes are provided in the flanges for attachment of the guide rail to an adjacent section of guide rail.

The lifting shackle comprises a head plate 1 which has a broad centralised aperture 4 into which may engage a winch hook or the like for raising and lowering the lifting shackle. A pair of load supporting arm means 2 are pivotably attached to the head plate 1 by means of respective pivot bars 3 which pass through apertures in the head plate 1. The apertures are spaced substantially equidistantly from a centre line of the head plate 1, which centre line also passes through the aperture 4.

Each of the load supporting arm means 2 has a U-shaped cross-section having a front arm **2*a* and a rear arm 2*b* defining between them an inwardly facing channel dimensioned to accept an outer edge of a lateral flange 7** of a guide rail to be supported.

Since the load supporting arm means 2 are attached pivotably to the head plate 1, the remote ends thereof may be spaced closer together or further apart than are the pivot bars 3 and therefore can accommodate a lift guide rail or other load of non-standard width.

The load is releasably attachable to the load supporting arm means 2 by means of a pair of removable load attachment bars 5, each passing through the front **2*a* and rear 2*b* arms of a respective one of the U-shaped load supporting arm means 2. Between the arms 2*a*, 2*b*, the load attachment bar 5 passes through an aperture in one of the guide rail lateral flanges 7. The load attachment bars 5 may be locked in place by wishbone clips 12 inserted transversely in through holes at opposite ends of each bar 5. The locking wishbone clips are retained on chains 13 attached to respective supporting arms 2**.

Each load supporting arm means 2 is provided with an internal load adjustment screw 9 extending through the front arm **2*a* of each supporting arm means 2 to contact a lateral flange 7 of the guide rail. These adjustment screws 9 may be set to align the centre of gravity of the up-ended guide rail with the hoist above, thereby avoiding many of the instability problems of the prior art. Since the channels between the front and rear panels of the load supporting arm means 2 are wide enough to accommodate a wide variation in flange thicknesses (with the load adjustment screws 9 holding the flanges at a preset position) and since the load support arm means 2** may pivot outwardly or inwardly to accommodate variation in the lateral extent of the flanges, the lifting shackle embodying the invention can be used to raise loads having a wide variation in cross-sectional size.

Since the load supporting arm means 2 are pivoted about points equi-distant from the lifting centre of the head plate 1, the load should always hang vertically below the aperture 4 if the fish plate holes in the load are also equi-distantly spaced from the centre of gravity of the load. If they are not, the pivoting supporting arm means 2 can accommodate at least small errors in such spacing.

The load adjustment screws also enable the centre of gravity of the load to be positioned directly below the aperture 4 and therefore the load should always hang plumb below the winch hook.

Thus, the lifting shackle embodying the present invention allows improved control over the raising and lowering of the guide rails, thus providing economies in installation time and labour and reducing damage to the rails during installation and lifting. The lifting shackle is relatively inexpensive in construction, and is therefore ideal for use on building sites.

Figure 4:
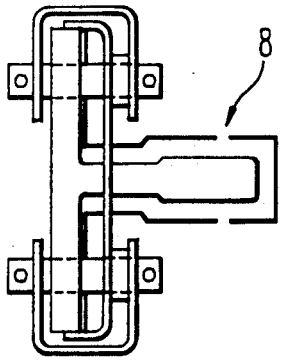
FIG. 4 is a plan view of the lifting shackle shown supporting a lift guide rail covered with a protective end cap.

As shown in FIG. 4, where guide rails may have protective end caps 8, the lifting shackle is still able to accommodate their cross-section.

I claim:

1. A lifting shackle for an elongated load to be lifted, said load including an end part having a pair of laterally spaced side edges extending in the same general direction away from said end part, said shackle comprising head plate means provided with an aperture, a pair of elongate load supporting arm means having first and second ends, means pivotably attaching the first end of each of said arm means to said head plate means at respective points substantially equidistant from a vertical, in use, axis of said head plate means passing through said aperture, each of said load supporting arm means comprising an elongate member of U-shape in horizontal cross sections having two rigidly interconnected arms which define therebetween an open-sided channel which is also open at said second end of said arm means, said channel extending from said open end towards said first end of said arm means, said pair of load supporting arm means being disposed, in use, with the open sides of said channels facing each other for receiving therein said laterally spaced side edges of said end part of said load to be lifted, and means adjacent said second end of each load supporting arm means for releasably engaging said arm means with said load to be lifted.

2. A lifting shackle as claimed in claim 1 wherein said means for releasably engaging said arm means with said load to be lifted comprise a removable load attachment bar passing through opposed apertures in said arms of each channel and being adapted to pass through an aperture adjacent a lateral edge of said load when received in a channel between said arms of each of the respective load supporting arm means.

3. A lifting shackle as claimed in claim 2, wherein said removable load attachment bars have exposed opposite ends and are each locked in place by a pair of clip means affixable to said exposed opposite ends.

4. A lifting shackle as claimed in claim 3, wherein chains attached to each load supporting arm means are connected to the respective clip means to retain said clip means with said shackle.

5. A lifting shackle as claimed in claim 2 including a pair of load adjustment screw means, one in each load supporting arm means and passing through one of the arms of each of said arm means, said screw means being adapted to bear against said load adjacent a lateral edge thereof and urge it towards the other arm of said load supporting arm means, whereby the position of said load on said bar within said channels of said load supporting arm means may be adjusted.

* * * * *